US006968662B2

(12) United States Patent
Rodrigues

(10) Patent No.: US 6,968,662 B2
(45) Date of Patent: Nov. 29, 2005

(54) SEALING COURSES OF SHINGLES

(75) Inventor: Tommy F. Rodrigues, Union, NJ (US)

(73) Assignee: Building Materials Investment Corporaion, Wilmington, DE (US)

( * ) Notice: Subject to any disclaimer, the term of this patent is extended or adjusted under 35 U.S.C. 154(b) by 91 days.

(21) Appl. No.: 10/309,435

(22) Filed: Dec. 4, 2002

(65) Prior Publication Data

US 2004/0107664 A1 Jun. 10, 2004

(51) Int. Cl.[7] ..... E04D 1/00

(52) U.S. Cl. ..... 52/518; 52/553; 52/554; 52/555; 52/741.4; 52/746.1; 52/748.1

(58) Field of Search ..... 52/554, 555, 518, 52/528, 553, 557, 315, 314; 156/260, 264, 257

(56) References Cited

U.S. PATENT DOCUMENTS 2,863,405 A * 12/1958 Leibrook et al. ..... 52/420
3,252,257 A * 5/1966 Price et al. ..... 52/518
3,848,384 A * 11/1974 Eaton et al. ..... 52/420
3,903,340 A 9/1975 Sheperd ..... 428/77
4,637,191 A * 1/1987 Smith ..... 52/522
4,824,880 A * 4/1989 Algrim et al. ..... 524/62
5,094,042 A * 3/1992 Freborg ..... 52/57
5,666,776 A * 9/1997 Weaver et al. ..... 52/557
6,083,592 A 7/2000 Chich ..... 428/40.3
6,190,754 B1 * 2/2001 Bondoc et al. ..... 428/143
6,199,338 B1 * 3/2001 Hudson, Jr. et al. ..... 52/518
6,471,812 B1 * 10/2002 Thompson et al. ..... 156/242

OTHER PUBLICATIONS http://www.crafco.com/Roofing%20Products/Roofing_Products.*

* cited by examiner

*Primary Examiner*—Daniel P. Stodola
*Assistant Examiner*—Nahid Amiri
(74) *Attorney, Agent, or Firm*—Marilyn J. Maue; William J. Davis

(57) ABSTRACT

The present invention relates to improved wind lift resistant self-sealing shingles having an adhesive-to-adhesive seal between courses of shingle installation.

8 Claims, 8 Drawing Sheets

SEALING COURSES OF SHINGLES

BACKGROUND OF THE INVENTION

Prior self-sealing composite and unitary roofing and siding shingles which generally employ heat and/or pressure sensitive globules, dabs, stripes or bands of adhesive are well known. The adhesive is commonly applied in a predetermined location on the top or under surface of the shingle unit so that, when courses are installed in a typical overlapping relationship, the adhesive on one sheet adheres to the successive shingle in the course. Typical self-sealing shingles of this type are described in U.S. Pat. Nos. 6,083,592; 3,903,340; 3,252,257 and 2,863,405. Since the exposed surfaces of shingles are coated with granules, sand or other weather resistant particles, courses are joined through an adhesive-to-mineral bond. Serious problems due to loss or shifting of the granules and weakening of the bond have resulted from this arrangement which are manifested in wind lift and/or shingle displacement. Also, inordinate time is required to obtain maximum bonding between courses in the present systems.

In order to strengthen the adhesion between courses, double and even triple rows of adhesive have been proposed for coating on the top or bottom surface of the shingle unit. While this solution may reduce damage due to wind lift because of the increased sealing sites, it significantly adds to the expense of the roofing material. Further, these solutions do not address low temperature bonding which under the present practice requires about 15 hours at 135° F. to complete.

Accordingly it is an object of this invention to overcome or minimize the above deficiencies by an inexpensive and commercially feasible bonding system.

Another object is to materially reduce the period of bonding required to unite courses of shingles or shingle components in roofing or siding.

Still another object is to provide a stronger, more durable system of bonding in a roofing or siding installation.

These and other objects and advantages of the invention will become apparent from the following description and disclosure.

SUMMARY OF THE INVENTION

The present invention involves applying adhesive to the top and under surfaces of a unitary or composite shingle unit in locations such that an adhesive-to-adhesive bond is formed when a first row of shingle units is overlapped by a second row during and after installation of courses and providing a modified shingle unit adapted to achieve unit-to-unit attachment through an adhesive-to-adhesive bond. The present bonding system can also be employed to join members of a composite shingle unit. In accordance with this innovation, adhesive is deposited in a horizontal band across the undersurface of the top sheet in an area where the backer strip in the assembly underlaps the top sheet; while on the top surface of the underlapping backer, adhesive is applied in a mateable horizontal band so that when the two components are brought together, adhesive-to-adhesive bonding takes place.

DETAILED DESCRIPTION AND PREFERRED EMBODIMENTS OF THE INVENTION

The present invention is directed to shingle units installed in overlapping courses which includes single and multiple ply unitary or composite shingles of asphaltic or non-asphaltic composition and to any adhesive conventionally employed to seal courses of shingles. In the composite type shingle, the same principal described herein for sealing courses by an adhesive-to-adhesive bond can be applied to laminate underlaying backup sheets to tabbed top sheets.

Suitable adhesives are those having a softening point of from about 180° to about 220° F. (ASTM 36); a penetration at 77° F. of from about 20 to about 75 (ASTM D5); a thermosel viscosity at 350° F. of between about 250 and about 1500 cp (ASTM D 4402) and a ductility at 77° F. of between about 40 and about 80 cm/min (ASTM D 113). Laminating adhesive No. 34557 and Single Tab adhesive No. 34562, both manufactured by CRAFCO INC., Chandler, Ariz. are particularly preferred. The adhesive composition may also contain about 0.5 to 50 wt. % of a conventional filler, e.g. limestone, talc and the like and/or about 0.5 to 50 wt. % of asphalt Type III (ASTM D 312).

Figure 1:
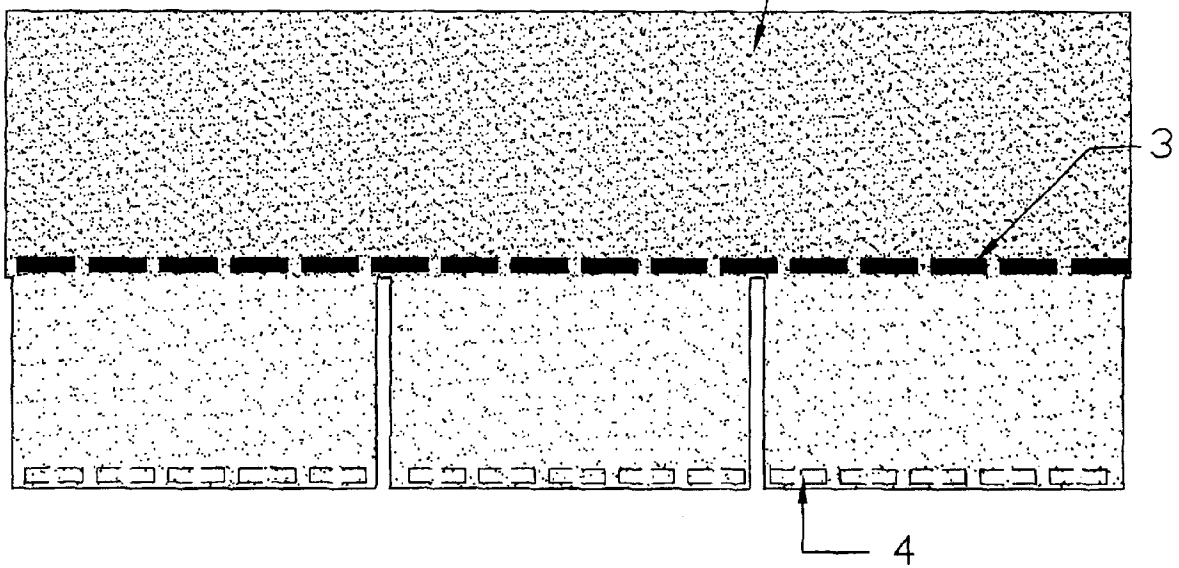
FIG. 1 is a top plan view of the present unitary shingle illustrating the top surface adhesive sites and correspondingly formed under surface adhesive sites.

One preferred embodiment, illustrated in FIG. 1 comprises a 17×40 inch unitary asphaltic shingle membrane 2, having adhesive dabs 3 spaced at about 0.5 inch apart on its surface and an equal number of similarly spaced and shaped adhesive dabs 4, shown in broken line, on the under surface of said membrane. However, it will be understood that other configurations of adhesive deposits that are mateable between courses of shingles can be employed without departing from the scope of this invention.

In this embodiment, dabs 4 are in alignment with dabs 3 so that upon overlapping a similar membrane over membrane 2, top surface dabs 3 engage under surface dabs on the successive overlapping membrane. Alternatively the adhesive dabs on either or both surfaces of membrane 2 and successive membranes can be replaced with a continuous strip or bead of adhesive so as to eliminate the need for horizontal alignment. As shown, dabs 3 are horizontally positioned on the top surface of the membrane across its proximate mid-section length; although adhesive sites located at about ¼ inch from the top margin of the membrane are also contemplated. In FIG. 1, adhesive dabs 3 are positioned horizontally about ½ the distance from the top membrane margin; whereas dabs 4 on the membrane under surface, indicated by broken line, are horizontally disposed across the length of the membrane in the lower portion of the sheet and are aligned with dabs 3. Preferably dabs 4 are horizontally positioned as close to the membrane bottom margin as is practical from a manufacturing standpoint.

The thickness of the adhesive deposits on the surfaces of the shingle membrane can vary between about 5 and about 40 mils; a thickness of from about 15 to about 30 mils being preferred.

Figure 2:
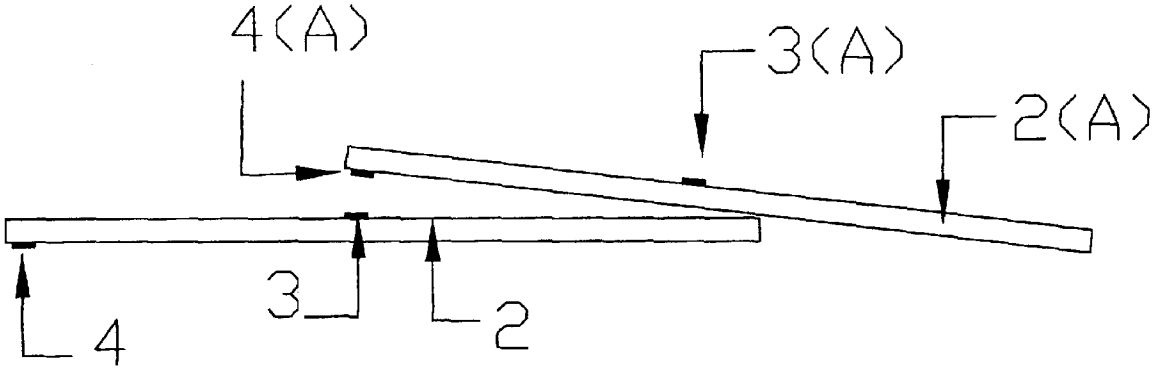
FIG. 2 is a sectional elevational side view of a course of unitary shingles illustrated in FIG. 1 when installed.

FIG. 2 illustrates the side view of a pair of installed courses of membranes where membrane 2 is overlapped with identical membrane 2(*a*). Membrane 2(*a*) has similar placement of adhesive dabs indicated as 3(*a*) and 4(*a*). As shown in the figure, top surface adhesive dab 3 of membrane 2 engages under surface dab 4(*a*) of membrane 2(*a*) to provide an adhesive-to-adhesive bond of superior strength and weather resistance.

Figure 3:
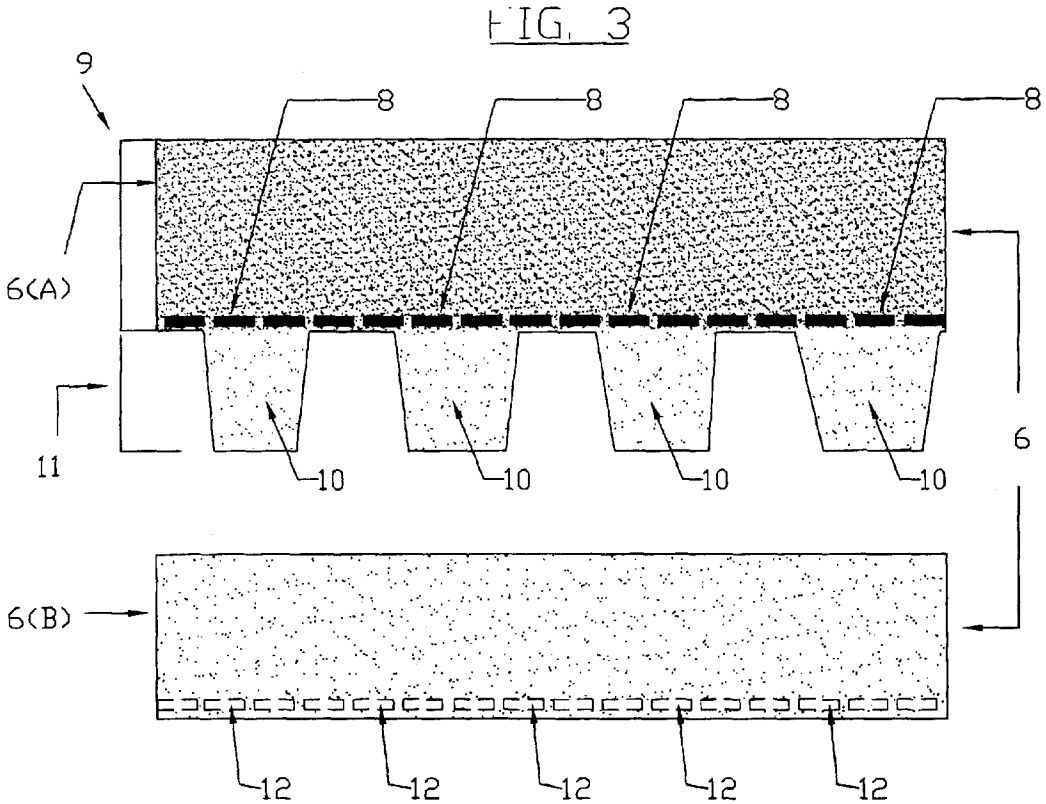
FIG. 3 is a top plan view of the components comprising the present composite shingle having a tabbed top sheet 6(*a*) and a backer strip 6(*b*).

Another preferred embodiment is illustrated by FIG. 3 showing individual parts of composite shingle 6 composed of 17×40 inch rectangular top sheet 6(*a*) and 8.5×40 inch rectangular backer sheet 6(*b*). Top sheet 6(*a*) comprises headlap portion 9 and butt portion 11 containing spaced tabs 10. In a horizontal area across headlap 9, a plurality of spaced adhesive strips 8 are located in the lower portion of the top surface of headlap 9, above tabs 8, and are positioned to define a predetermined overlap area for successive composite shingle courses when installed on a substrate such as a roof deck. Undivided backer sheet 6(*b*) of the same longitudinal dimension as top sheet 6(*a*) has a width greater than the height of tabs 10 and is adapted to completely fill the spaces between tabs 10 and to extend vertically under the adhesive strips on the top surface of headlap 9. The underside of backer 6(*b*) also contains, in a bottom horizontal area across its length, adhesive strips 12, shown by broken line. Strips 12 are of similar size, shape and number as strips 8 and are aligned with strips 8 in vertical relationship.

Figure 4:
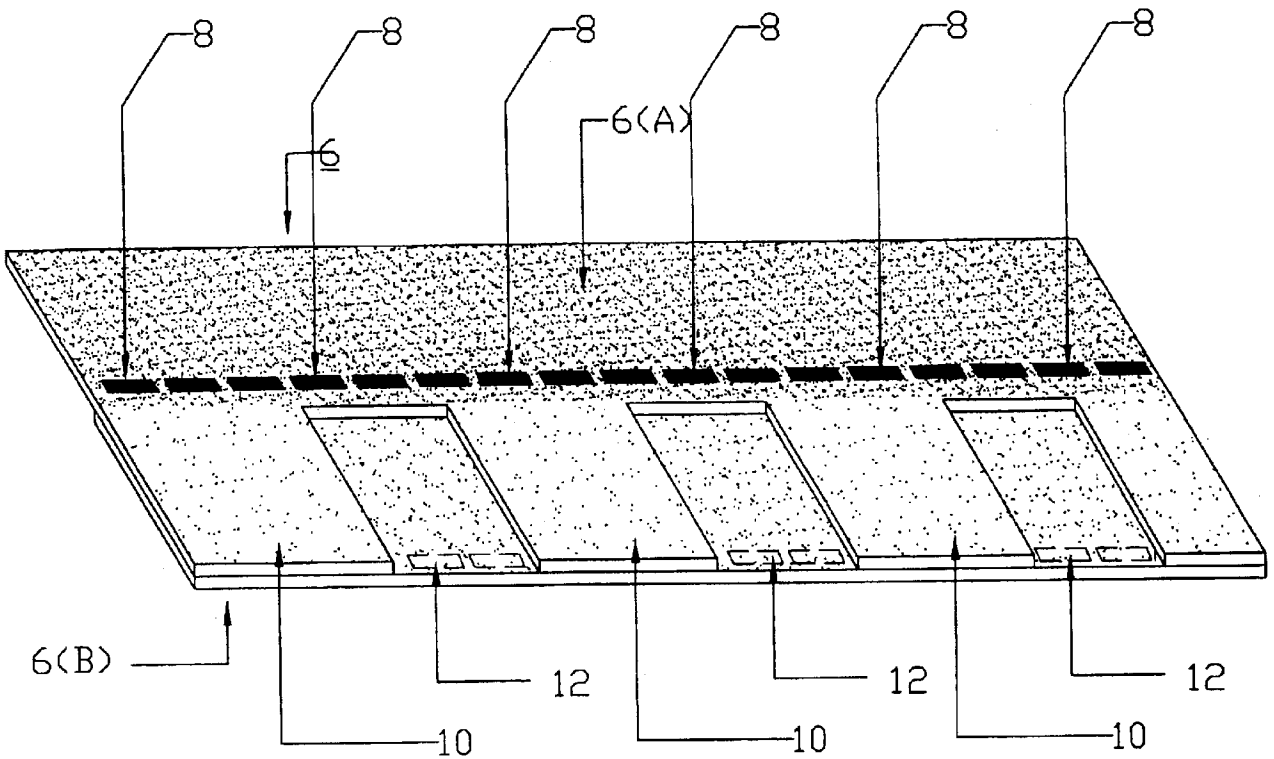
FIG. 4 is a perspective view of the top surface of the composite shingle illustrated in FIG. 3 when assembled.
Figure 5:
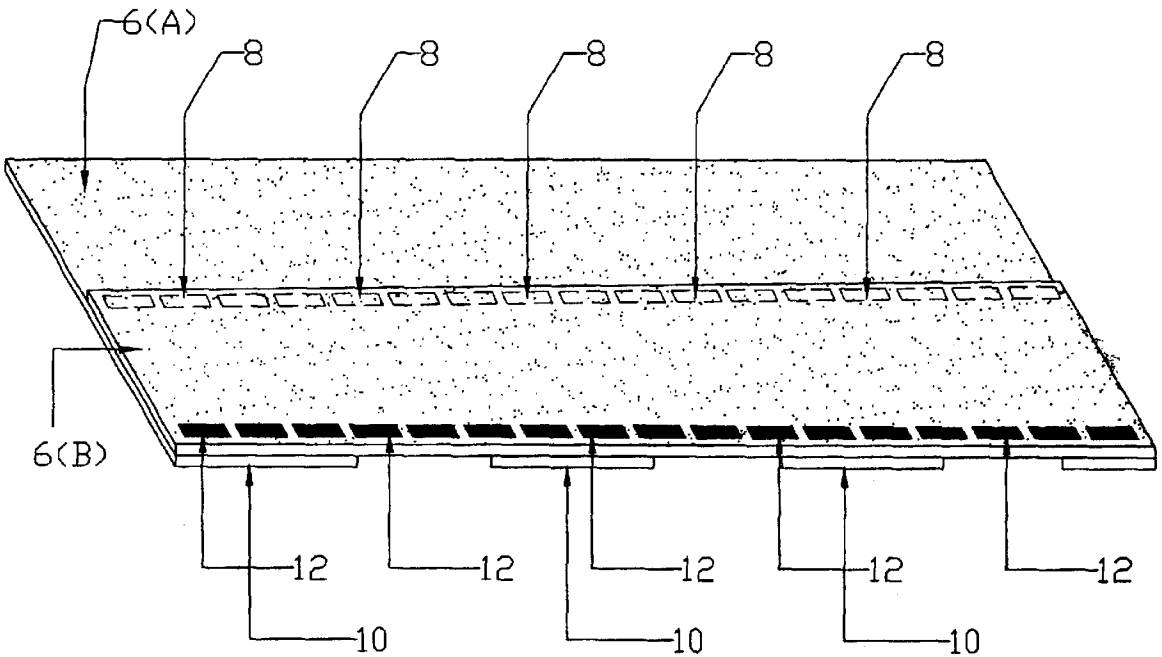
FIG. 5 is a perspective view of the under surface of the assembled composite shingle illustrated in FIG. 4.

FIG. 4 illustrates the top view of assembled composite shingle 6 and FIG. 5 shows the back if assembled shingle 6.

Figure 6:
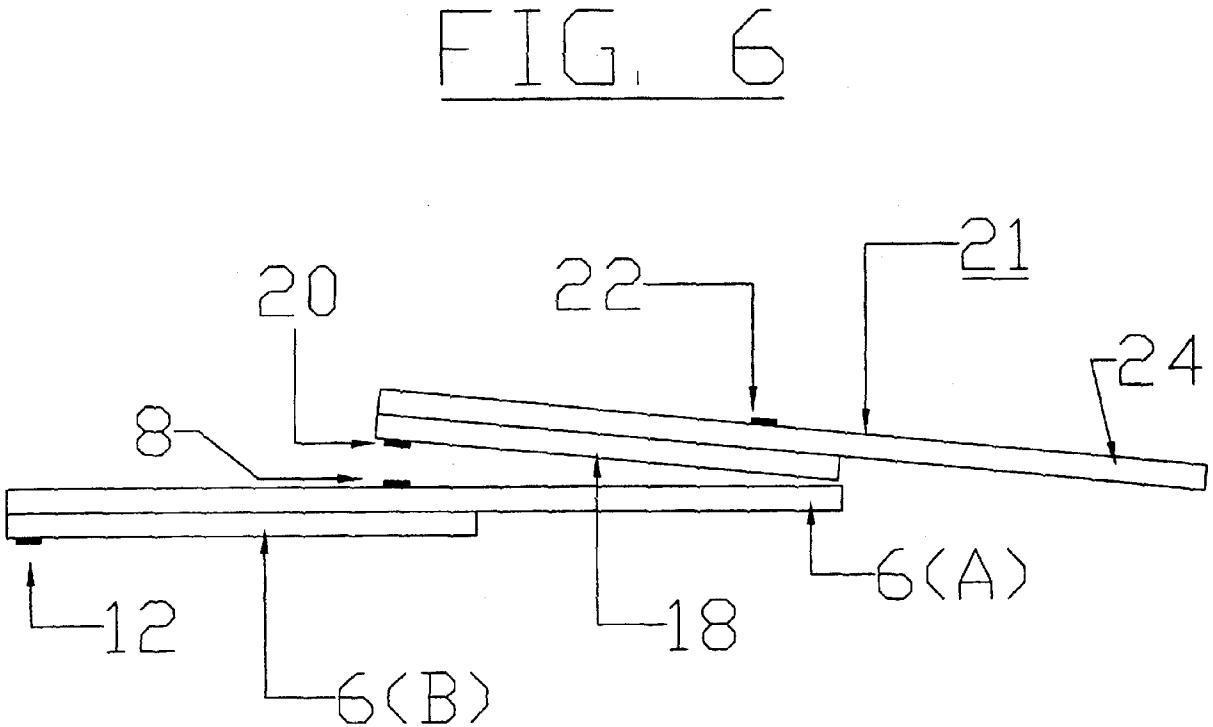
FIG. 6 is a sectional elevational side view of a course of composite shingles when installed.

FIG. 6 is a cross-sectional side view of shingle 6 type courses when installed on a roof. In the drawing, composite shingle 6 and all its component parts are shown underlaying second composite shingle 21 having identical parts and configuration. More specifically, overlapping tabbed top sheet 24 corresponds to 6(*a*); surface adhesive strips 22 correspond to adhesive strips 8; backer sheet 18 corresponds to backer sheet 6(*b*) and aligned adhesive adhesive strips 20 on the underside of shingle 21 correspond to aligned adhesive strips 12 on the underside of shingle 6. As illustrated, when shingle 21 is installed over shingle 6 in overlapping relationship, adhesive strip 20 on the bottom of 21 engages adhesive strip 8 on the top of shingle 6 to provide a stronger, wind resistant adhesive-to-adhesive bond between the courses.

Figure 7:
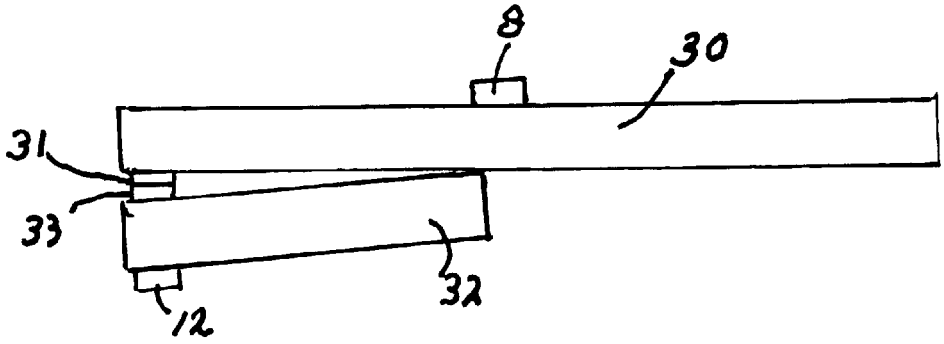
FIG. 7 is a cross-sectional side view of a composite shingle wherein members of the composite are joined by an adhesive-to-adhesive bond and FIG. 8 is a top plan view of a composite shingle where the adhesive on the top surface of the top sheet membrane is a continuous band or strip of adhesive and the adhesive on the under surface of the backer strip membrane are dabs of adhesive.

FIG. 7 illustrates a cross-sectional side view of the adhesive-to-adhesive bonding of top sheet member 30 and backer sheet 32 in composite shingle 40 wherein adhesive area 31 is located on the under surface of top sheet member 30 and mates with a similar adhesive area 33 located on the upper surface of backer sheet 32, thereby joining members 30 and 32 in adhesive-to-adhesive bonding to form a composite shingle. Courses of this composite shingle are installed as indicated in FIG. 6.

Figure 8:
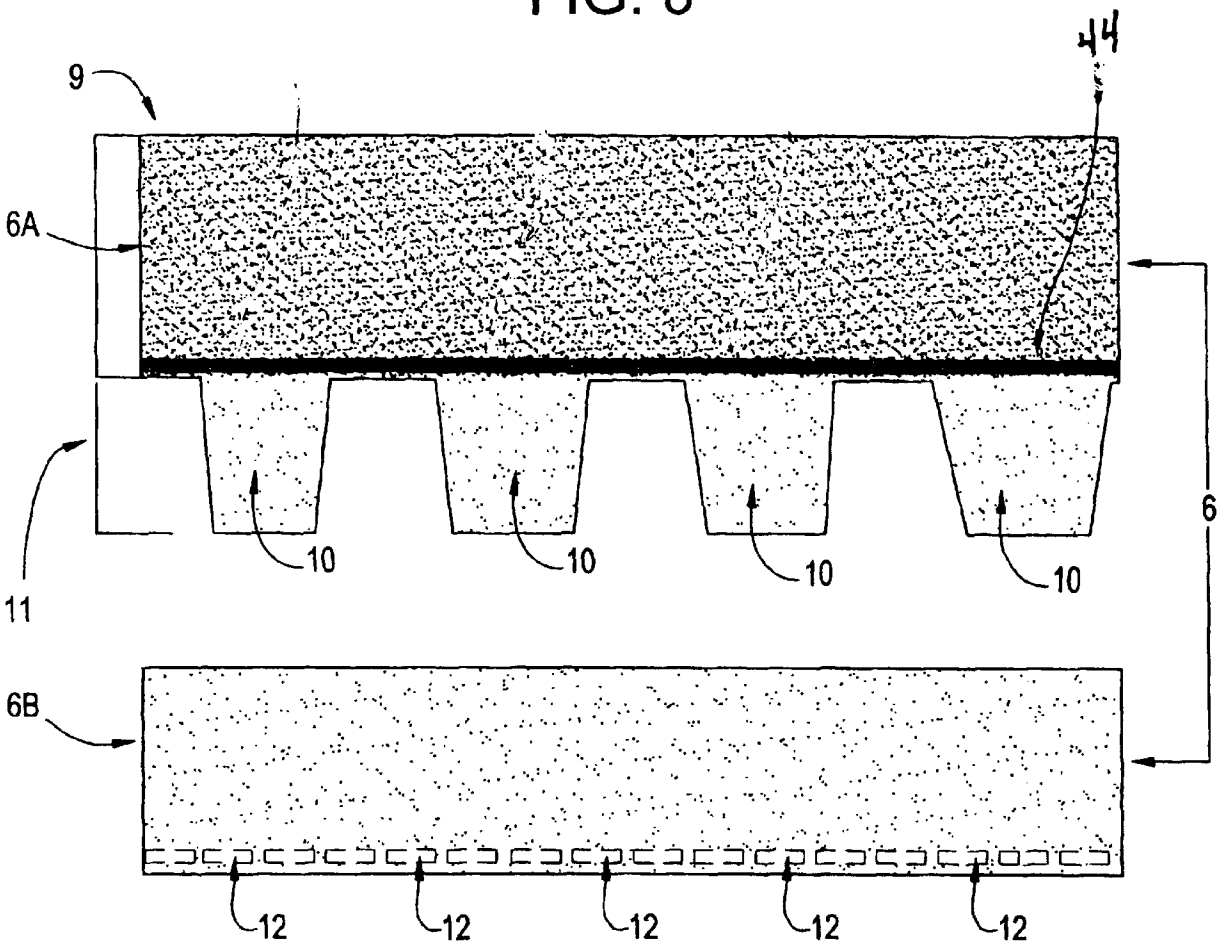

FIG. 8 illustrates composite shingle 42 identical to that of FIG. 3 except that adhesive strips 8 are replaced with a continuous horizontal band or strip of adhesive, indicated by numeral 44. The increased strength of the present shingle is shown in FIG. 6 and described in the following example comparing courses of shingles employing adhesive-to-granular surface bonding and the present shingle using adhesive-to-adhesive bonding.

EXAMPLE 1–3

The following tests were carried out to evaluate the improvement in resistance to wind lift when self-sealing shingles have an adhesive-to-adhesive bond between courses. The shingles employed in the comparison table were GAF Materials Corporation single ply strip shingles surfaced with mineral granules. The undersurface of sample shingles A was each coated with a horizontal band of Laminating Adhesive 34557 obtained from CRAFCO INC. in a thickness of 0.50 inch. No adhesive was applied to the top surface of shingle sample A.

The undersurface of shingle sample B was coated with a 0.125 inch thick horizontal band of the same adhesive and was additionally coated on its top surface with a 0.125 inch thick horizontal band of the adhesive in a band alignment with the adhesive band on the undersurface of B.

A second shingle (A'), identical with shingle A, was impressed over the first shingle A to simulate shingle courses joined by adhesive-to-mineral bonding. In like manner, a second shingle (B'), identical with shingle B, was impressed over the first shingle B, so that the adhesive band on the top surface of B engaged the adhesive band on the undersurface of shingle B' in the arrangement simulating shingle courses joined by adhesive-to-adhesive bonding.

The pairs of shingles A–A' and B–B' were individually cured at a temperature of 80° F. over a period of 2 hours and the average force needed to separate A from A' and B from B' were measured and recorded as shown in the following table.

The above procedure was repeated at different curing temperatures, namely at 100° F. and at 120° F. and the force required to separate the shingles in each pair is also reported in the Table.

TABLE

| Example No. | Shingle Sample | Av. Lbs. Force |
|---|---|---|
| 1 | A | 1.6063 |
| | B | 4.1873 |
| 2 | A | 4.7410 |
| | B | 6.3760 |
| 3 | A | about |
| | B | equal |

Although the invention has been illustrated for only certain unitary and composite shingles, it will become apparent that many modifications and substitutions for roofing and siding applications can be made in the description and drawings without departing from the scope of this invention. For example, the adhesive-to-adhesive bonding can be employed to laminate components of a two, three or more membered composite shingle by aligning adhesive deposits on opposing surfaces of composite members. These and other modifications will become obvious from the teachings herein.

What is claimed is:

1. In a shingle unit suitable for overlapping course installation which is a composite shingle comprising (a) a top sheet having a spaced tab butt portion and an undivided headlap portion having a top free surface and (b) an underlying, undivided backer strip filling the spaces between said tabs and extending upwardly beneath the headlap portion of the top sheet having a top surface and a free under surface, the improvement which comprises said top sheet joined to said backer strip by a first band of adhesive on the lower under surface portion of said tabs and a second, mateable adhesive band on the lower top surface of said backer strip adapted to provide an adhesive-to-adhesive bond between the top sheet and the backer strip of the shingle unit and wherein said composite shingle unit also has a horizontal band of adhesive disposed on the top free surface of said headlap portion in an area of overlapping with a successive shingle unit and a corresponding band of adhesive horizontally disposed on the under free surface of the backer strip in an area which is mateable with the adhesive band on the headlap top free surface of a successive composite shingle unit to form an adhesive-to-adhesive bond between composite shingle units when installed in courses.

2. The shingle unit of claim 1 wherein the first and second bands of adhesive are continuous matching strips of adhesive.

3. The shingle unit of claim 1 wherein the first and second bands of adhesive are spaced dabs of adhesive of similar size and shape and wherein the spaced dabs of adhesive in the second band are vertically aligned with those in the first band.

4. The shingle unit of claim 1 wherein one of the bands of adhesive is a plurality of spaced dabs and the other band of adhesive is a continuous horizontally disposed strip of adhesive.

5. The shingle unit of claim 1 wherein both bands of adhesive are continuous, horizontally disposed strips of adhesive.

6. The shingle unit of claim 1 wherein the adhesive has a softening point of from about 170° to about 220° F.; a penetration at 77° F. of from about 20 to about 75; a thermosel viscosity at 350° F. of between about 250 and about 1500 cp and a ductility at 77° F. of between about 40 and about 80 cm/min.

7. The shingle unit of claim 1 wherein the thicknesses of the applied adhesive on the surfaces of the top sheet and the backer strip are between about 15 and about 35 mils.

8. A shingle assembly in overlapping course installation of the composite shingles of claim 1 wherein the adhesive band on each under free surface of the respective backer strip engages a corresponding adhesive band on the headlap upper free surface in a successive course to form an adhesive-to-adhesive bond.

* * * * *